US005852880A

United States Patent [19]

Harrison

[11] Patent Number: 5,852,880

[45] Date of Patent: Dec. 29, 1998

[54] METHOD OF DRYING LUMBER

[76] Inventor: Jack B. Harrison, 3450 Palmdale Dr., Wasilla, Ak. 99654

[21] Appl. No.: 852,330

[22] Filed: May 7, 1997

Related U.S. Application Data

[62] Division of Ser. No. 690,754, Aug. 1, 1996, Pat. No. 5,687,490.

[51] Int. Cl.[6] ..... F26B 13/30

[52] U.S. Cl. ..... 34/92; 34/212; 34/77; 34/284

[58] Field of Search ..... 34/92, 77, 212, 34/242, 284

[56] References Cited

U.S. PATENT DOCUMENTS

| | | | |
|---|---|---|---|
| 3,309,778 | 3/1967 | Erickson | 34/284 |
| 3,939,573 | 2/1976 | Berti | 34/26 |
| 4,106,215 | 8/1978 | Rosen | 34/217 |
| 4,255,870 | 3/1981 | Malmquist | 34/35 |
| 4,893,415 | 1/1990 | Moldrup | 34/16.5 |
| 5,595,000 | 1/1997 | Goodwin, III | 34/471 |
| 5,687,490 | 11/1997 | Harrison | 34/92 |

*Primary Examiner*—Henry A. Bennett
*Assistant Examiner*—Pamela A. Wilson
*Attorney, Agent, or Firm*—Michael J. Tavella

[57] ABSTRACT

A method for drying wood by placing the wood in a dehydration chamber in which the temperature, humidity and pressure are controlled. Air and or gasses are circulated in the chamber to wick away moisture while the wood remains frozen. Both the internal temperature and the circulating air are kept below freezing during the drying process. Atmospheric pressure is manipulated to enhance drying and may be either increased or reduced. Exposure to the volume of dry air (air with zero percent humidity) varies with the drying process and depends on the species, the quantity of wood to be dried and the initial moisture content of the material.

8 Claims, 3 Drawing Sheets

METHOD OF DRYING LUMBER

This is a division of Ser. No. 08/690,754 filed Aug. 1, 1996 now Pat. No. 5,687,490.

This invention relates to methods for drying lumber and particularly to methods for drying lumber using freeze drying techniques.

BACKGROUND OF THE INVENTION

The process of drying wood so that it can be stabilized and worked has been on going since wood was first utilized as a building material. Wood is most stable and workable when its moisture content is below six percent (unless one is using a green lumber construction method). The earliest drying method used air to cure the wood. Wood was stacked on racks and allowed to dry naturally. This often takes months or years depending on the climate. Another common drying method is kiln drying-where lumber is placed in a drying oven to dry under heat. This method takes days or weeks to dry lumber. However, kiln drying is difficult because the temperature conditions must be precise. Otherwise, the wood is subject to checking or warping. Moreover, some woods cannot be kiln-dried until the wood has air dried for up to two years.

Improvements in drying techniques have developed over the years. For example, U.S. Pat. Nos. 2,534,714 and Re Pat. No. 27,124 teach the ideas of freezing wood solid before heating it in a kiln. The latter patent adds the step of bringing the wood to room temperature before rapid heating is accomplished. Both of these methods increase the use of energy needed to dry wood because first the wood must be frozen and then it is subjected to high heat in the kiln.

U.S. Pat. No. 3,283,412 teaches a method of drying that uses cold brine to chill wood placed in a vessel to low temperatures. The wood sits above the brine. As the wood chills, the moisture in the wood is pulled to the surface by a vacuum pump, where it freezes. Superheated steam is then injected into the vessel. The steam sublimates the moisture on the surface of the boards, which is then carried away by the vacuum.

Freeze drying techniques—i. e., that of freezing a substance and then sublimating the moisture from the material by vacuum while the material is still frozen has been used with cellulosic materials, but not for lumber. Examples of freeze drying cellulosic materials include U.S. Pat. No. 4,543,734, which covers the drying of water soaked books by freeze drying; U.S. Pat. No. 5,104,411, which covers the freeze drying-cross linking of cellulose fibers for use in diapers and the like; and U.S. Pat. No. 2,444,124, which covers the freeze drying of regenerated cellulose for use with artificial materials that are formed with water and cellulose fibers.

All the latter group of patents described above used freeze drying on pulp or paper forms of cellulose. None teaches or suggests the technique for use with green lumber. All the other techniques that use some sort of freezing of lumber teach thawing the limber in either a kiln under high heat or be using the brine-steam technique taught in U.S. Pat. No. 3,283,412. All of these techniques have the inherent problems of drying wood with heat, including the use of large amounts of energy for freezing, thawing and drying the wood.

SUMMARY OF THE INVENTION

The present invention overcomes all of these difficulties. The instant invention, also called Reduced Atmosphere Freeze-Drying (RAFD) is a method for drying wood by placing the wood in a dehydration chamber in which the temperature, humidity and pressure are controlled. Air and or gasses are circulated in the chamber to wick away moisture while the wood remains frozen. Both the internal temperature and the circulating air are kept below freezing during the drying process. Atmospheric pressure is manipulated to enhance drying and may be either increased or reduced. Exposure to the volume of dry air (air with zero percent humidity) varies with the drying process and depends on the species, the quantity of wood to be dried, and the initial moisture content of the material.

No heat is used in drying, unlike kiln drying. The temperature in the chamber can vary from −2° F. to −100° F. or more. By adjusting the atmospheric pressure within the dehydration unit, moisture can be removed from the cells with minimum structural damage to the cells. This method of drying wood not only prevents checking, collapsing or warping, it also causes less shrinkage in most species tested in both hard and soft woods.

Moreover, treatment at very low temperatures (i.e., between —100° F. and —300° F.) noticeably relieved stress in the wood being treated, which produced a more stable, less warped material.

There are two processes disclosed that are used to dry wood. The first is for soft woods and the second is for hard woods. The process for treating soft woods uses cold, dry air that is circulated under positive pressure to dry the wood. The wood is dried in a chamber. The cold, dry air is circulated through the chamber, where it picks up moisture from the wood. The wet air is then removed from the chamber, heated, dried and cooled for recirculation into the chamber. The cool dry air is blown in under positive pressure to wick away the moisture.

The process for drying hard woods uses a vacuum chamber. The temperature of the chamber is kept at about +30° F. The chamber is kept at a vacuum of about −16 mm Hg. This is average for most species of hard wood. A lower level vacuum does not seem to produce any faster sublimation of the moisture in the wood and it uses more energy.

Compared to kiln drying, the freeze drying method uses considerably more energy; however, the freeze drying does not damage the wood being dried. Kiln drying typically destroys up to half of all hardwoods and up to 25 percent of softwoods. Moreover, freeze drying is a much faster process than kiln drying and works on all species of wood. These advantages often outweigh the additional energy cost of freeze drying.

It is an object of this invention to produce a method of drying wood that does not use heat to dry the wood.

It is another object of this invention to produce a method of drying wood that reduces the stress in wood as the drying process is accomplished.

It is yet another object of this invention to produce a method of drying wood that uses freeze drying techniques to dry the wood.

It is a further object of this invention to produce a method of drying wood that allows for adjustments to the drying time and amounts of moisture content.

It is a further object of this invention to produce a method of drying wood that can manipulate the temperature of the wood during the drying process to further reduce stress in the wood.

DETAILED DESCRIPTION OF THE INVENTION

Water can exist in three different physical states, i. e., a solid (ice), liquid (water) and a gas (water vapor). Under controlled conditions, water can change from the solid form to the vapor form without passing through the liquid. Such a transformation is called sublimation. Sublimation can occur under freezing conditions accelerated by negative or positive pressure.

Figure 1:
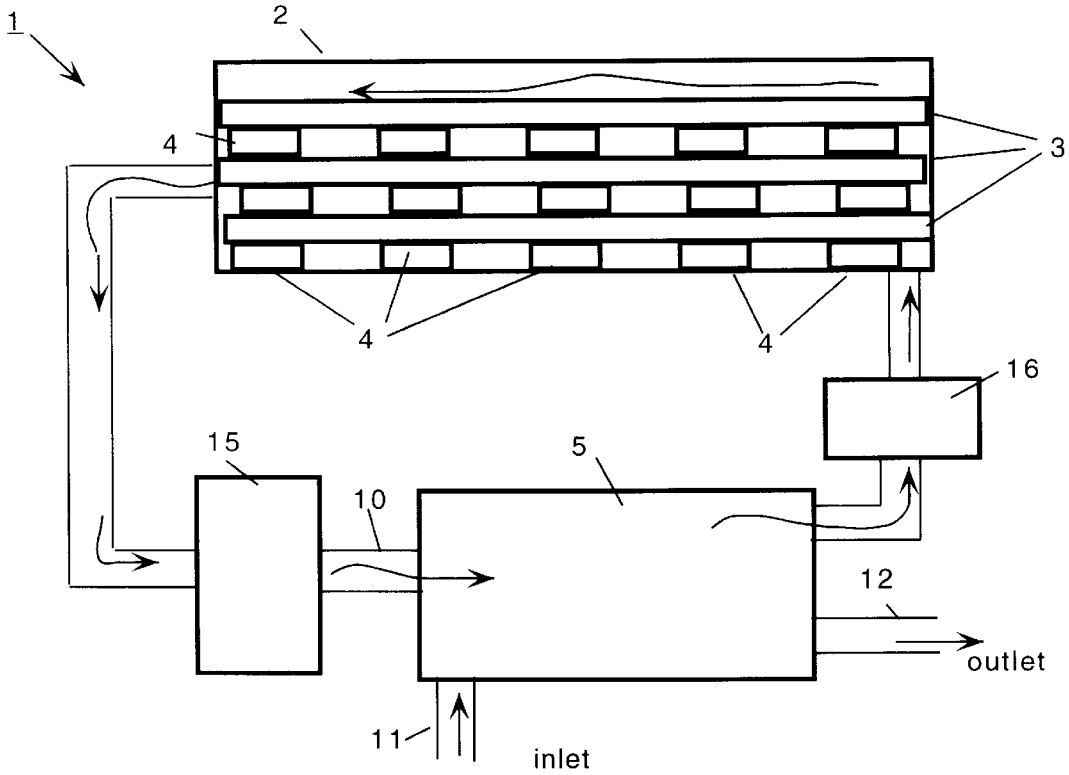
FIG. 1 is a schematic view of a system for drying wood using the embodiment of the present invention for use with soft woods.

The process is different for soft woods and hard woods. For soft woods the process shown in FIG. 1 is used and uses the following steps. First, green stumpage is cut to dimensional lumber, stickered and stacked in preparation for placement into the wood drying chamber 2. This is done according to common industrial milling practices and is exactly the same procedure used before kiln treating of the wood.

Referring now to FIG. 1, the dehydration system 1 is shown. Here, the wood drying chamber 2 is shown. Inside the wood drying chamber 2, a quantity of soft wood 3 is set on stickers 4 to allow for air circulation around the wood 3. An air drying chamber 5 is another element of the system. The air drying chamber 5 has a desiccant carousal that rotates to dry an air stream passing through it. The air drying chamber 5 has two inputs. The first 10 is for the air to be dried. The second 11 is to receive additional air to replenish the supply. An exhaust 12 leaves the air drying chamber 5 as shown. Two other components of the system include a heater 15 and a refrigeration unit 16.

Soft wood, either frozen or unfrozen, is placed in the wood drying chamber 2. If the wood is frozen first, it is typically frozen in small lots that can be moved by a fork lift. It does not matter when or how the wood is frozen; it can be done in the wood drying chamber 2. This method is not preferred, however, because it increases the time spent in the wood drying chamber 2 that could be put to use drying wood. In fact, mills in the Northern climates can leave wood outdoors in the winter, allowing it to freeze naturally, which saves the energy needed to freeze the wood.

Once the wood is placed in the wood drying chamber 2, the temperature in the wood drying chamber 2 can be kept at any temperature that maintains the wood in a frozen state. However, as discussed below, the preferred temperature is between −100° F. and −300° F. A positive pressure of about +3 mm Hg is maintained in the wood drying chamber 2. Air is then placed into the air drying chamber 5, where it is brought down to zero percent humidity. The dry air is then pumped into the refrigeration unit 16, where it is cooled to the temperature of the wood drying chamber 2. The cold, dry air is then pumped into and through the wood drying chamber 2. In the wood drying chamber 2, the dry air picks up moisture from the wood. The now-moist air then exits the wood drying chamber 2. This air is cold and wet. The air then passes through the heater 15, where it is warmed to +70° F. The warmed air then passes into the air drying chamber 5 where it is dried, ready for the next cycle.

Figure 2:
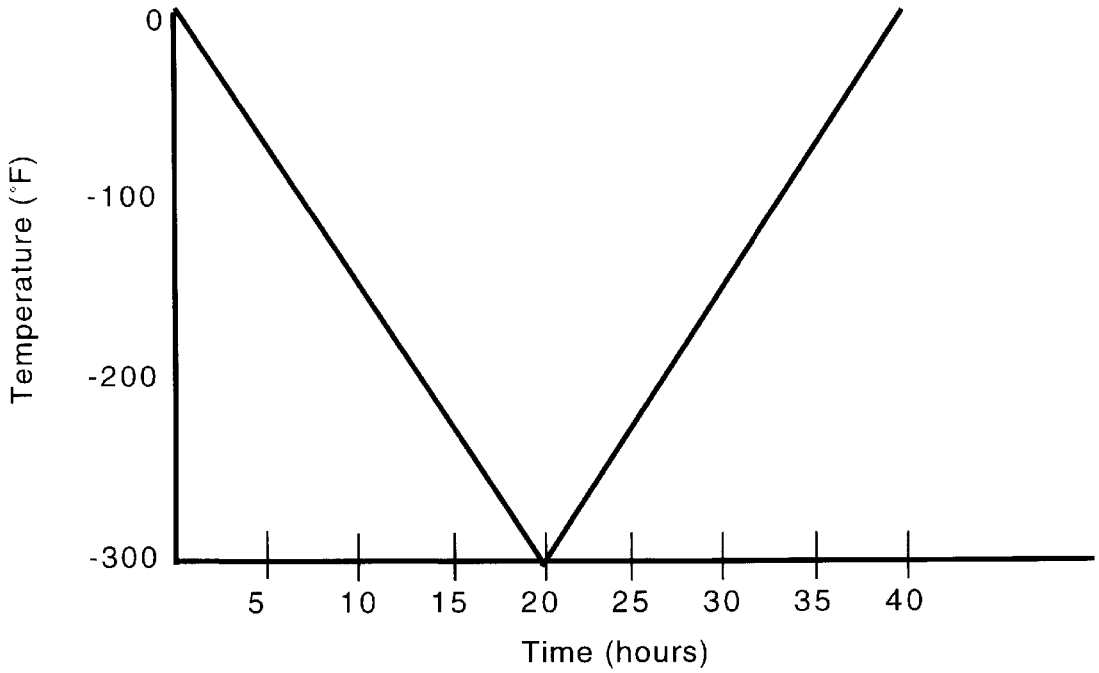
FIG. 2 is a graphical representation of stress relieving treatment showing the temperature changes over time.

As discussed above, the preferred temperature range for drying wood that produces a dried wood product that is relieved of all stress is between −100° F. and −300° F. However, the optimum range is set out over a number of hours according to the graph shown in FIG. 2. Here, the wood is brought down from zero degrees F to −300° F. in about 20 hours. The wood is then brought back up to zero degrees F over the next twenty hours. This regimen produces the best results.

Figure 3:
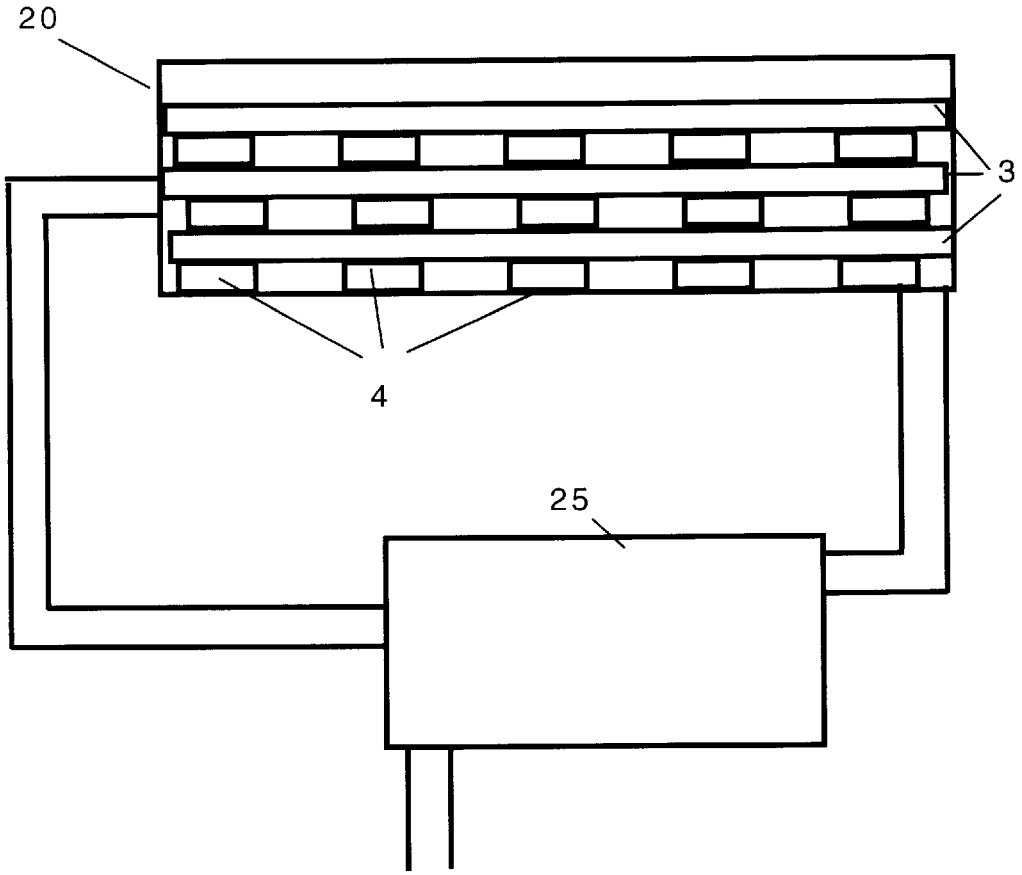
FIG. 3 is a schematic view of a system for drying wood using the embodiment of the present invention for use with hard woods.

Referring now to FIG. 3, details for drying hardwoods are shown. For hardwoods, a vacuum freeze-drying process is used. Here, the wood is frozen as before. A wood drying chamber 20 is provided and the wood is placed in the wood drying chamber 20, stickered as discussed above. It is preferred that wood is frozen first, although it is possible to freeze the wood in the wood drying chamber. 20. Because hardwood is inherently more stable that soft wood, the low temperature regime as outlined above is not necessary for hard woods, but can be done if desired. One can follow this procedure, but little to no benefit will be realized. For hardwoods, the temperature should be maintained at or about 30 degrees F. It must remain below 32 degrees F to maintain the frozen state of the wood. A vacuum of about −16 mm HG is formed within the wood drying chamber 20 using a conventional vacuum pump system. The vacuum is maintained for a sufficient period for the wood to reach the desired moisture level. This time is considerably shorter than that of a kiln.

Although the use of a vacuum pump requires a great deal of energy compared to a kiln, the kiln can damage as much as half of a supply of hardwood. The freeze drying method does not damage any of the wood. Moreover, kiln drying can take as much as ten times as long as the freeze drying. Thus, for hardwoods, freeze drying is the preferred method over kiln drying.

The dried wood can be treated by cross-linking the wood fibers using formaldehyde and sulfur dioxide. This type of treatment is discussed in U.S. Pat. No. 5,318,802. Treatment of the wood can be done either in the wood drying chamber 2 or in a separate chamber (not shown).

The steps listed above are basic and must be adjusted to the particular species of wood being treated. Adjustments are by way of calibration of the equipment, rather than experimentation. The overall operating parameters do not change radically between species; however, optimum levels may vary considerably between species. Once these levels are determined, the settings can be used whenever the particular species is being dried.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A method of drying wood, having a moisture content comprising the steps of:

a) placing a plurality of lengths of frozen wood into a drying chamber, having an air pressure therein;

b) sealing the drying chamber;

c) reducing the air pressure within the drying chamber to a partial vacuum;

d) extracting moist air from the drying chamber; and e) repeating step (d) until the moisture content of the plurality of lengths of wood reaches a desired level.

2. The method of drying wood of claim 1 further comprising the steps of: applying formaldehyde and sulfur dioxide gasses into the drying chamber, after the plurality of lengths of frozen wood have reached a desired moisture content, to enable cross linking wood fiber molecules within the plurality of lengths of frozen wood.

3. The method of drying wood of claim 1 wherein the partial vacuum is kept at about −16 mm of mercury.

4. The method of drying wood of claim 1 wherein the plurality of lengths of frozen wood are kept at a temperature Of about 30° F.

5. The method of drying wood of claim 1 wherein the plurality of lengths of frozen wood are kept at a temperature of between 0° F. and −300° F.

6. The method of claim 5 wherein after the temperature of the plurality of lengths of frozen wood is brought down from 0° F. to −300° F. over a twenty hour period following a linear rate of decent.

7. The method of claim 5 wherein after the temperature of the plurality of lengths of frozen wood is brought down from 0° F. to −300° F. over a twenty hour period following a linear rate of decent, the temperature of the plurality of lengths of frozen wood is brought up from −300° F. to 0° F. over a twenty hour period following a linear rate of ascent.

8. The method of claim 1 wherein the plurality of lengths of frozen wood are hard wood.

* * * * *